US009848714B2

(12) United States Patent
Burns et al.

(10) Patent No.: US 9,848,714 B2
(45) Date of Patent: Dec. 26, 2017

(54) PLAY YARD WITH REMOVABLE ENCLOSURE

(75) Inventors: Steve Burns, Cumming, GA (US); Er-Jui Chen, Fen-San (TW); Mark Mendes, Loganville, GA (US)

(73) Assignee: KIDS II, INC., Atlanta, GA (US)

( * ) Notice: Subject to any disclaimer, the term of this patent is extended or adjusted under 35 U.S.C. 154(b) by 809 days.

(21) Appl. No.: 13/182,138

(22) Filed: Jul. 13, 2011

(65) Prior Publication Data

US 2012/0012801 A1 Jan. 19, 2012

Related U.S. Application Data

(60) Provisional application No. 61/363,902, filed on Jul. 13, 2010.

(51) Int. Cl.

| | |
|---|---|
| ***A47D 13/06*** | (2006.01) |
| ***A47D 7/00*** | (2006.01) |
| ***A47D 15/00*** | (2006.01) |

(52) U.S. Cl.

CPC ..... *A47D 13/063* (2013.01); *A47D 7/002* (2013.01); *A47D 13/06* (2013.01); *A47D 13/061* (2013.01); *A47D 15/008* (2013.01); *Y10T 29/49826* (2015.01)

(58) Field of Classification Search

CPC . A47D 7/00; A47D 7/002; A47D 7/02; A47D 13/06; A47D 13/061; A47D 13/063; A47D 13/066; A47D 15/008

USPC ..... 5/99.1, 98.1

See application file for complete search history.

(56) References Cited

U.S. PATENT DOCUMENTS

| | | | |
|---|---|---|---|
| 914,104 | A | 3/1909 | Binney |
| 2,423,402 | A | 7/1947 | Olsen |
| 2,486,054 | A | 10/1949 | Morse |
| 2,698,443 | A | 1/1955 | Ralick |
| 2,889,840 | A | 6/1959 | Warnock |
| 3,834,400 | A | 9/1974 | Sattler |

(Continued)

FOREIGN PATENT DOCUMENTS

| | | |
|---|---|---|
| AU | 2008101208 A4 | 1/2009 |
| CN | 201104680 | 8/2008 |

(Continued)

OTHER PUBLICATIONS

International Search Report and the Written Opinion of International Searching Authority dated Nov. 2, 2011, Application No. PCT/US2011/041717.

(Continued)

*Primary Examiner* — Nicholas F Polito
*Assistant Examiner* — David R Hare
(74) *Attorney, Agent, or Firm* — Gardner Groff Greenwald & Villanueva, PC

(57) ABSTRACT

Various embodiments of the present invention are directed to a play yard configured for providing an enclosed space for a child. According to various embodiments, the play yard comprises a rigid support frame and removable, washable liner. The frame includes one or more channels configured to receive engagement members positioned on the liner in order to form a bounded play yard space. By permitting the liner to be secured to the frame via the retention members, a user is able to easily secure the liner to the frame for use and remove the liner from the frame for washing.

23 Claims, 14 Drawing Sheets

(56) References Cited

U.S. PATENT DOCUMENTS

| | | | | |
|---|---|---|---|---|
| 3,851,848 | A | 12/1974 | Wiele | |
| 4,004,306 | A | 1/1977 | Gutner | |
| 4,538,309 | A | 9/1985 | Gunter | |
| 4,817,655 | A | 4/1989 | Brooks | |
| 4,862,940 | A | 9/1989 | Atchison | |
| 4,865,066 | A | 9/1989 | Brooks | |
| 4,967,432 | A | 11/1990 | Kujawski et al. | |
| 5,161,080 | A | 11/1992 | Funayama et al. | |
| 5,241,716 | A | 9/1993 | Kohus | |
| 5,324,096 | A | 6/1994 | Schultz | |
| 5,408,770 | A | 4/1995 | Suzuki | |
| 5,614,288 | A | 3/1997 | Bustos | |
| 5,615,427 | A | 4/1997 | Huang | |
| 5,845,349 | A | 12/1998 | Tharalson et al. | |
| 5,845,423 | A | 12/1998 | Hicks | |
| 5,867,850 | A * | 2/1999 | Mariol | 5/93.2 |
| 5,991,944 | A | 11/1999 | Yang | |
| 6,098,217 | A | 8/2000 | Hammil | |
| 6,131,218 | A | 10/2000 | Wang | |
| 6,131,638 | A | 10/2000 | Levin | |
| 6,148,456 | A | 11/2000 | Tharalson et al. | |
| 6,233,759 | B1 | 5/2001 | Warner, Jr. et al. | |
| 6,430,762 | B1 | 8/2002 | Cheng | |
| 6,434,767 | B1 | 8/2002 | Welsh, Jr. | |
| 6,539,563 | B1 | 4/2003 | Hsia | |
| 6,634,038 | B2 | 10/2003 | Hsia | |
| 6,735,796 | B2 | 5/2004 | Warner, Jr. et al. | |
| 6,859,957 | B1 | 3/2005 | Chen | |
| 6,874,177 | B2 | 4/2005 | Hsia | |
| 6,901,613 | B1 | 6/2005 | Hsia | |
| 7,055,191 | B1 | 6/2006 | Chen | |
| 7,401,366 | B1 | 7/2008 | Costa | |
| 7,526,821 | B2 * | 5/2009 | Chen et al. | 5/98.1 |
| 7,568,242 | B2 | 8/2009 | Troutman | |
| 7,739,759 | B2 | 6/2010 | Mendes et al. | |
| 7,752,688 | B2 | 7/2010 | Chen et al. | |
| 7,882,579 | B2 | 2/2011 | Jackson et al. | |
| 7,958,578 | B2 | 6/2011 | Shan et al. | |
| 8,141,186 | B2 | 3/2012 | Burns et al. | |
| 8,201,291 | B2 | 6/2012 | Burns et al. | |
| D672,988 | S | 12/2012 | Suvak et al. | |
| RE43,919 | E | 1/2013 | Chen | |
| 8,490,227 | B2 | 7/2013 | Troutman | |
| D699,063 | S | 2/2014 | Stitchick et al. | |
| 8,640,278 | B2 | 2/2014 | You et al. | |
| 8,656,530 | B2 | 2/2014 | You et al. | |
| 8,955,174 | B1 | 2/2015 | Lawlor et al. | |
| 2001/0001161 | A1 | 5/2001 | Warner et al. | |
| 2001/0001162 | A1 | 5/2001 | Warner et al. | |
| 2001/0001330 | A1 | 5/2001 | Warner et al. | |
| 2002/0078499 | A1 | 6/2002 | Cheng | |
| 2002/0092094 | A1 | 7/2002 | Welsh | |
| 2003/0070229 | A1 | 4/2003 | Hsia | |
| 2003/0070230 | A1 | 4/2003 | Hsia | |
| 2003/0154547 | A1 | 8/2003 | Hsia | |
| 2004/0187207 | A1 | 9/2004 | Hsia | |
| 2005/0262629 | A1 * | 12/2005 | Cheng et al. | 5/98.1 |
| 2005/0268398 | A1 | 12/2005 | Tharalson et al. | |
| 2006/0185082 | A1 * | 8/2006 | Casati Troutman | 5/99.1 |
| 2006/0230528 | A1 | 10/2006 | Church | |
| 2008/0115269 | A1 * | 5/2008 | Chen | A47D 13/066 5/99.1 |
| 2009/0077738 | A1 | 3/2009 | Burns et al. | |
| 2009/0077739 | A1 | 3/2009 | Mendes et al. | |
| 2009/0077740 | A1 | 3/2009 | Jackson et al. | |
| 2009/0077741 | A1 | 3/2009 | Burns et al. | |
| 2009/0077742 | A1 | 3/2009 | Burns et al. | |
| 2009/0133190 | A1 * | 5/2009 | Chen | A47C 31/023 5/93.1 |
| 2009/0188039 | A1 | 7/2009 | Shan et al. | |
| 2009/0260155 | A1 | 10/2009 | Troutman | |
| 2010/0132115 | A1 | 6/2010 | Hsu | |
| 2012/0042447 | A1 | 2/2012 | You et al. | |
| 2012/0211713 | A1 | 8/2012 | You et al. | |
| 2012/0216346 | A1 | 8/2012 | Rampton et al. | |
| 2014/0068857 | A1 | 3/2014 | Jackson et al. | |

FOREIGN PATENT DOCUMENTS

| | | | |
|---|---|---|---|
| CN | 201213630 | | 4/2009 |
| DE | 202008016861 | U1 | 4/2009 |
| EP | 0144165 | A1 | 6/1985 |
| EP | 1147727 | A1 | 10/2001 |
| EP | 1712160 | A1 | 10/2006 |

OTHER PUBLICATIONS

International Search Report and the Written Opinion of International Searching Authority dated Feb. 9, 2012, Application No. PCT/US2011/043896.

International Preliminary Examining Authority, International Preliminary Report on Patentability, including Applicant's Dec. 21, 2012 Amendments Under Article 34 and Response to Written Opinion on Preliminary Examination, for International Application No. PCT/US2011/041717, dated May 31, 2013, 44 pages, European Patent Office, The Netherlands.

International Preliminary Examining Authority, Written Opinion (second) for International Application No. PCT/US2011/041717, dated Feb. 19, 2013, 7 pages, European Patent Office, The Netherlands.

United States Patent and Trademark Office, Office Action for U.S. Appl. No. 13/034,313, dated May 29, 2014, 13 pages, USA.

IP Australia, Australian Government, Examination Report No. 1 for Application No. 2011279242, dated Mar. 25, 2014, 4 pages, Australia.

European Patent Office, Extended European Search Report for Application No. EP11807471.5, dated May 12, 2015, 10 pages, Germany.

Australian Government, IP Australia, Patent Examination Report No. 2 for Application No. 2011279242, Jun. 17, 2015, 5 pages, Australia.

United States Patent and Trademark Office, Office Action for U.S. Appl. No. 13/034,313, dated Sep. 10, 2014, 13 pages, USA.

European Patent Office, Communication Pursuant to Rule 164(1) EPC (Supplemental Partial Search Report) for Application No. EP11807471, dated Jan. 27, 2015, 6 pages, Germany.

United States Patent and Trademark Office, Office Action for U.S. Appl. No. 13/034,313, dated Apr. 10, 2015, 13 pages, USA.

* cited by examiner

PLAY YARD WITH REMOVABLE ENCLOSURE

CROSS-REFERENCE TO RELATED APPLICATIONS

This application claims priority from provisional U.S. Application Number 61/363,902 entitled "Play Yard with Removable Fabric Enclosure," which was filed on Jul. 13, 2010 and is herein incorporated by reference.

BACKGROUND OF THE INVENTION

Field of the Invention

Various embodiments of the present invention described herein generally relate to children's play yard apparatuses and methods for attaching and removing a play yard liner to a play yard frame.

Description of Related Art

A play yard is a containment device often used for providing a partially enclosed space for a child. Typically, play yards include a rigid frame having upper and lower horizontal frame members joined by vertical frame members. A floor panel and sidewalls are usually defined in between the frame members along with an upper opening through which a child may be moved in and out of the play yard. The sidewalls and floor panel are often comprised of a fabric material disposed over the frame members. In addition, the frame members may be collapsible to allow for easier portability and storage of the play yard.

Recent play yards have been provided with a fabric enclosure that may be secured to a play yard frame in order to form surrounding sidewalls. For example, U.S. Pat. Nos. 6,859,957, 7,568,242, and U.S. Publication No. 2010/0132115 disclose play yards including a fabric enclosure having vertical corner posts. The vertical posts of the enclosures are configured to be inserted into vertical tubes disposed on a play yard frame, thereby permitting the enclosure to be assembled and secured to the play yard frame. However, enclosures having posts—such as those in the above-referenced patent publications—can often be difficult to secure to a corresponding play yard frame. As the vertical posts must be closely aligned with their respective vertical tubes in order to be inserted into the tubes, assembling each corner of the fabric enclosure to the play yard frame can be tedious and time consuming.

In addition, as play yard enclosures often become soiled as a result of use by infants, it is desirable for such play yard enclosures to be easily washable. However, the enclosures described in the above-referenced patent publications are not configured for being machine washed when disassembled from the play yard frame. In other play yards, such as that disclosed in U.S. Pat. No. 7,401,366, a removable slip cover or liner of similar size and shape to that of a play yard enclosure is provided. The slip cover or liner is positioned on the play yard enclosure to form a barrier between the play yard's permanent fabric enclosure and an infant or child positioned therein. Such slip covers or liners may be removed and washed separately. However, this configuration requires the use of a redundant fabric liner that adds cost to the consumer and requires the consumer to maintain an additional component to use the play yard. Further, the additional fabric associated with the slip cover or liner can be detrimental to the visibility of the child from the perspective of a caregiver as it may cover or reduce visibility through transparent portions of the play yard walls. In addition, such slip covers and liners often interfere with the play yard's functional features, aesthetics, and airflow through the play yard's walls.

Accordingly, there remains a need in the art for an improved play yard having a removable, washable liner that is easily secured to and removed from a play yard frame. In addition, there is a need for a removable liner configured for use with a collapsible play yard frame and configured for covering various components of the frame, such as joints between frame members.

BRIEF SUMMARY OF THE INVENTION

Various embodiments of the present invention are directed to a children's play yard. According to various embodiments, the play yard comprises a play yard frame and a removable play yard liner. The play yard frame generally comprises one or more lower horizontal frame members and one or more vertical frame members. According to various embodiments, the vertical frame members extend upwardly from the lower horizontal frame members and define one or more vertical channels. The removable play yard liner generally comprises one or more sidewalls and one or more engagement members disposed along the sidewalls. The engagement members are dimensioned to be inserted within the channels of the vertical frame members such that the sidewalls of the play yard extend between the vertical frame members of the play yard frame and define a bounded area within the play yard. In certain embodiments, the play yard liner is constructed from machine-washable materials and is configured for being machine-washed when removed from the play yard frame.

In addition, according to various embodiments, the vertical channels of the play yard frame define an upper opening having a cross-sectional width that is substantially larger than the cross-sectional width of the engagement members. In further embodiments, the cross-sectional width of the vertical channels may also taper downward toward a narrower width at a medial portion of the vertical channels.

Furthermore, various embodiments of the play yard frame may also comprise one or more upper horizontal frame members, while the play yard liner further comprises one or more flap panels. In certain embodiments, the flap panels of the play yard liner may be configured to extend over and cover the upper horizontal frame members—including joints connecting adjacent upper horizontal frame members—when the play yard liner is secured to the play yard frame.

Moreover, a method for securing a removable play yard liner to a play yard frame is contemplated comprising the steps of setting up a play yard frame to have one or more vertical frame members defining vertical channels and one or more upper horizontal frame members; orienting a play yard liner having one or more sidewalls, one or more flap panels, and one or more engagement members such that the engagement members are generally adjacent the vertical frame members; sliding the one or more engagement members into the vertical channels such that the full length of the engagement members is within the vertical channels; positioning the flap panels over upper portions and around outer side portions of the one or more upper horizontal frame members; and securing the flap panels over the one or more upper horizontal frame members.

BRIEF DESCRIPTION OF THE SEVERAL VIEWS OF THE DRAWING(S)

Reference will now be made to the accompanying drawings, which are not necessarily drawn to scale, and wherein.

DETAILED DESCRIPTION OF THE INVENTION

The present inventions will now be described more fully hereinafter with reference to the accompanying drawings, in which some, but not all embodiments of the inventions are shown. Indeed, these inventions may be embodied in many different forms and should not be construed as limited to the embodiments set forth herein. Rather, these embodiments are provided so that this disclosure will satisfy applicable legal requirements. Like numbers refer to like elements throughout.

Various embodiments of the present invention are directed to a play yard configured for providing an enclosed space for a child. According to various embodiments, the play yard is generally comprised of a play yard frame (e.g., the frame 100 described herein) and a removable play yard liner (e.g., the liner 200 described herein). Generally, the play yard frame is a substantially rigid structure configured for receiving and supporting the removable liner, which may be constructed from a flexible, washable material. When secured to the frame, the removable liner defines a partially enclosed space dimensioned for receiving a child.

Play Yard Frame

Figure 1:
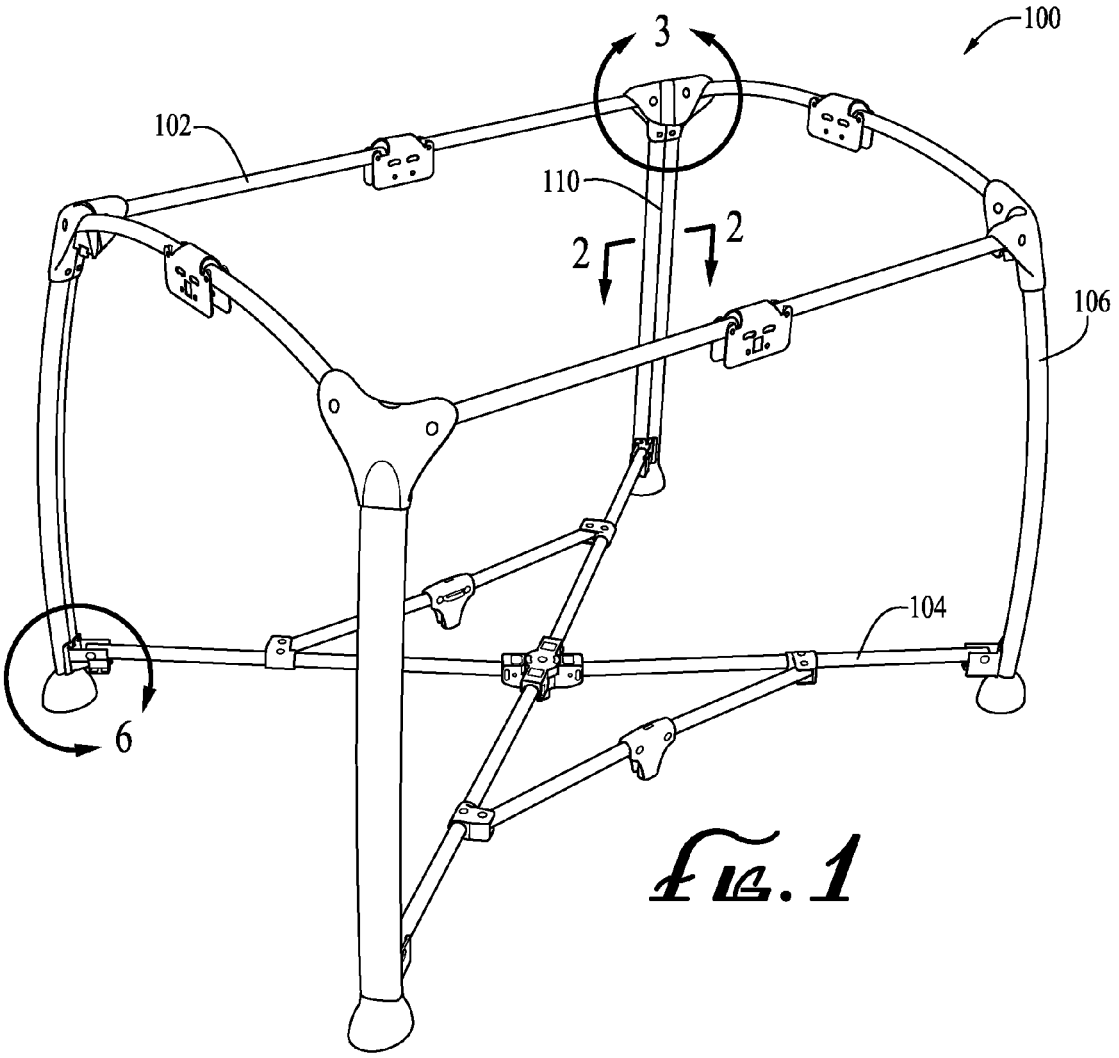
FIG. 1 shows a perspective view of a play yard frame according to one embodiment of the present invention.

FIG. 1 illustrates a play yard frame 100 according to one embodiment. In the illustrated embodiment, the frame 100 includes a plurality of upper horizontal frame members 102, a plurality of lower horizontal frame members 104, and four vertical frame members 106. As shown, the vertical frame members 106 are positioned at the corners of the frame 100 and include feet configured to rest on a floor or support surface. The upper horizontal frame members 102 and lower horizontal frame members 104 are connected at different heights to the vertical frame members 106 such that they are vertically spaced from one another. The upper horizontal frame members 102 extend between adjacent vertical frame members 106, thereby forming an upper perimeter of the frame 100. The lower horizontal frame members 104 are positioned inwardly from the vertical frame members 106 and are connected to one another at various points to form a lower support surface spaced above the floor (or other support surface upon which the frame 100 is positioned). The terms "horizontal" and "vertical" are used herein to indicate components that are generally horizontally or vertically oriented with respect to a floor (or other support surface) and are not intended to indicate that particular components must be strictly or entirely horizontal or vertical.

According to various embodiments, each of the vertical frame members 106 define a vertical channel 110. As shown in FIG. 1, the vertical channels 110 extend longitudinally from the upper end of the vertical frame members 106 (e.g., proximate to the upper horizontal frame members 102) to the lower end of the vertical frame members 106 (e.g., proximate to the lower horizontal frame members 104). As described in greater detail herein, the vertical channels 110 are configured to provide a cavity in which an engagement member (e.g., a rod) of the play yard liner 200 may be inserted. By inserting such engagement members into the vertical channels 110 of each of the vertical frame members 106, the play yard liner 200 may be secured in tension between adjacent vertical frame members 106.

Figure 2:
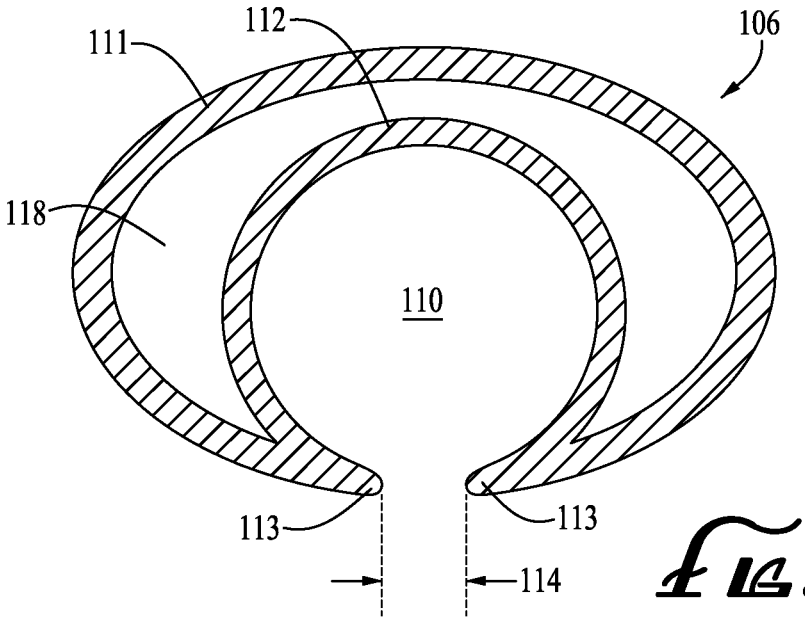
FIG. 2 shows a cross-sectional view of a vertical frame member according to one embodiment of the present invention.

The vertical channels 110 are defined by the cross-sectional shape of the vertical frame members 106. For example, FIG. 2 illustrates the cross-section of a portion of a vertical frame member 106 according to one embodiment. As shown in FIG. 2, the vertical frame member 106 comprises an outer wall 111 and a channel wall 112. The channel wall 112 forms a recessed portion of the vertical frame member 106 and defines the cross-sectional shape of the channel 110. In the illustrated embodiment of FIG. 2, the channel wall 112 is concave and forms a generally elliptical shape. At the point where the ends of the channel wall 112 meet the outer wall 111, a pair of channel arms 113 are formed. The space between the channel arms 113 defines a gap 114, which results in the channel 110 remaining in spatial communication with the area outside of the vertical frame members 106. As described in greater detail herein, the gap 114 extends longitudinally along the vertical frame member 106 and is dimensioned to permit an engagement member inserted into the channel 110 to remain attached to the play yard liner 200.

Figure 3:
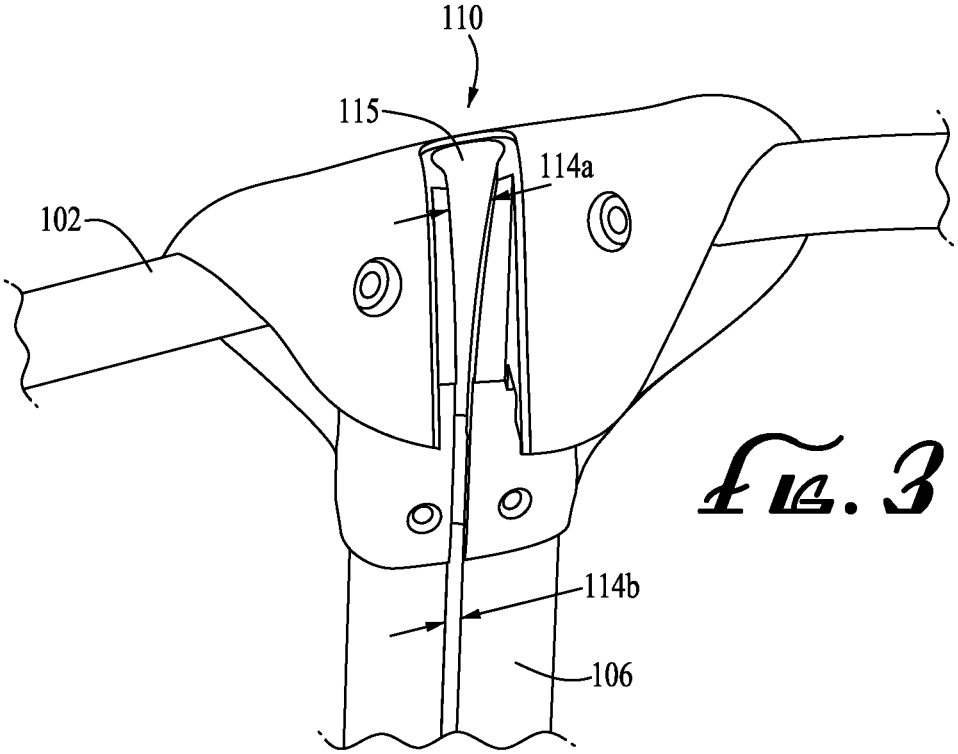
FIG. 3 shows a perspective view of the upper portion of a vertical frame member according to one embodiment of the present invention.

FIG. 3 shows the upper portion of one of the vertical frame members 106 according to one embodiment. As shown in FIG. 3, the vertical frame member's channel 110 includes an upper opening 115 positioned at a height proximate to the upper horizontal frame members 102. In the illustrated embodiment, the upper opening 115 is configured such that the channel 110 is generally wider at its upper end and tapers to a narrower dimension toward its medial portion. For example, as shown in FIG. 3, the gap 114 is wider at a point 114*a* near the top of the vertical frame member 106 and narrower at a point 114*b* proximate a medial portion of the vertical frame member 106.

As will be appreciated from the description herein, the vertical frame members 106 may be configured to define channels having a variety of cross-sectional profiles. For example, in various other embodiments, the channel wall 112 may be configured such that the channel 110 has a cross-section that is non-elliptical and resembles other polygons having dimensions capable of retaining an engagement member.

According to various embodiments, the vertical frame members 106 defining the channels 110 may be constructed from an extruded piece of metal (e.g., aluminum) or another material of sufficient rigidity and strength to support loads applied by the play yard liner 200 (e.g., high-modulus polymer materials). In such embodiments, the vertical frame member's outer wall 111 and channel wall 112 may constitute different portions of a single, continuous wall (e.g., as shown in the embodiment of FIG. 2). However, in other embodiments, the vertical frame members 106 may be constructed from separate pieces affixed together. In addition, according to various embodiments, the vertical frame members 106 may be substantially solid or may define a hollow interior space (e.g., the cavity 118 shown in FIG. 2).

Figure 4:
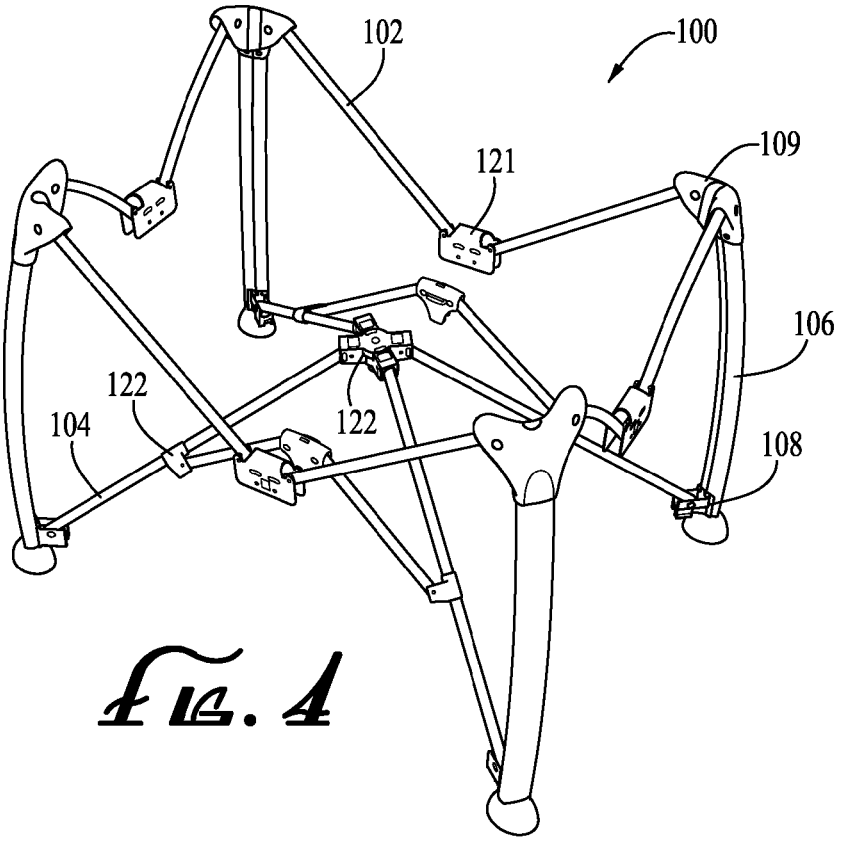
FIG. 4 shows a perspective view of a partially collapsed play yard frame according to one embodiment of the present invention.

In certain embodiments, the frame 100 is also configured to be collapsed into a more compact form in order to minimize the space required for storage. For example, FIG. 4 illustrates the frame 100 in a partially collapsed state according to one embodiment. In the illustrated embodiment, the frame 100 includes upper connecting members 109 positioned at the upper ends of the vertical frame members 106 and upper joint members 121 disposed between the upper horizontal frame members 102. In particular, the upper horizontal frame members 102 are pivotally connected to one another by the upper joint members 121 and pivotally connected to the vertical frame members 106 by the upper connecting members 109. In the illustrated embodiment, each upper horizontal frame member 102 is secured to an upper joint member 121 and an upper connecting member 109 by pins that permit the upper horizontal frame member 102 to pivot in a downward direction. As shown in FIG. 4, the upper connecting members 109 and upper joint members 121 permit each of the upper horizontal frame members 102 to move downward along a plane perpendicular to a support surface on which the frame 100 rests.

Likewise, the frame 100 also includes lower connecting members 108 positioned at the lower ends of the vertical frame members 106 and lower joint members 122 disposed between the lower horizontal frame members 104. In particular, the lower horizontal frame members 104 are pivotally connected to one another by the lower joint members 122. In addition, certain of the lower horizontal frame members 104 are pivotally connected to the vertical frame members 106 by the lower connecting members 108. In the illustrated embodiment, the lower horizontal frame members 104 are secured to the various lower joint members 122 and connecting members 108 by pins that permit the lower horizontal frame members 104 to pivot in an upward direction. However, as will be appreciated from the description herein, the various upper and lower horizontal frame members 102, 104 may be secured to the joint members 121, 122 and connecting members 108, 109 by various other fastening mechanisms permitting the frame members to move between an expanded and collapsed state.

Figure 5:
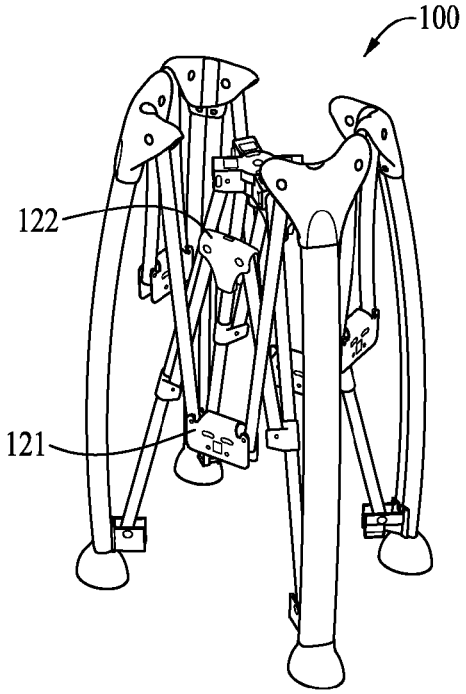
FIG. 5 shows a perspective view of a collapsed play yard frame according to one embodiment of the present invention.

FIG. 5 illustrates the frame 100 in a fully collapsed state according to one embodiment. By pivoting the upper horizontal frame members 102 downward and the lower horizontal frame members 104 upward, the vertical frame members 106 are able to move inward and adjacent one another, thereby achieving the fully collapsed state of FIG. 5. According to various embodiments, one or more of the various joint members 121, 122 and connecting members 109, 108 may further include locking mechanisms configured to selectively lock the frame 100 in an expanded position, such as that of FIG. 1, and selectively unlock the frame 100 to permit it to be collapsed to a storage position, such as that of FIG. 5. In addition, a quick release mechanism may be provided to permit a user easily unlock or lock the frame 100. Further, as will be appreciated from the description herein, the frame 100 may be collapsed with or without a play yard liner secured to it (e.g., the liner 200 described below).

Figure 6:
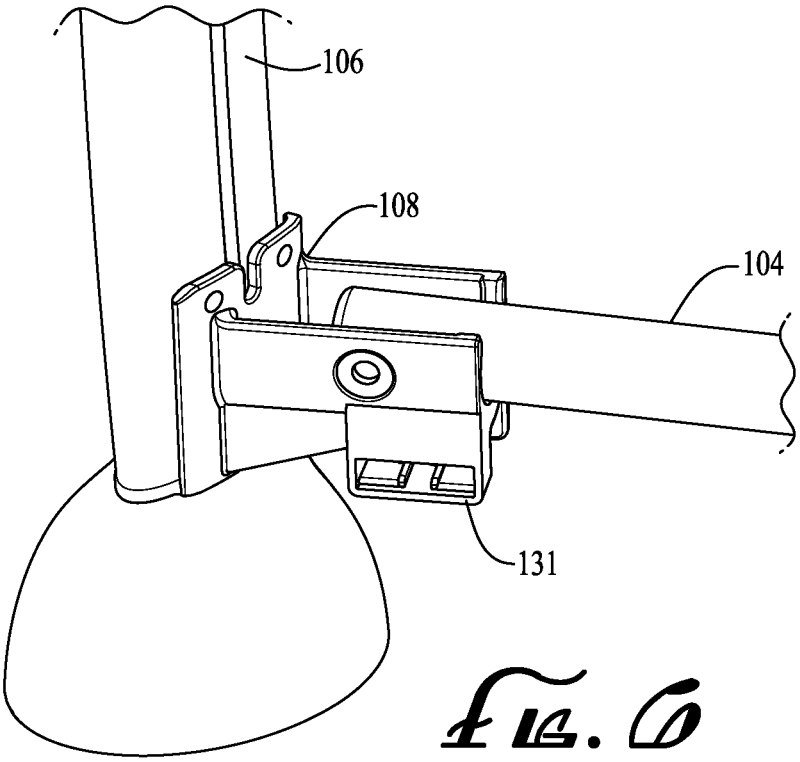
FIG. 6 shows a perspective view of a lower connecting member of a play yard frame according to one embodiment of the present invention.

According to various embodiments, the frame 100 may further include one or more fasteners. As described in greater detail herein, these fasteners may be configured to engage corresponding fasteners on the play yard liner 200. For example, as shown in FIG. 6, a lower frame fastener 131 is provided on each of the lower connecting members 108 positioned at the bottom of the vertical frame members 106 proximate the lower horizontal frame members 104. In the illustrated embodiment, the lower frame fastener 131 is a female side-release buckle component configured to receive and secure a male side-release buckle component (e.g., the lower liner fasteners 231 described below). However, as will be appreciated from the description herein, the fastener components provided on the frame 100 may comprise a variety of fasteners, such as snaps, buttons, clasps, buckles, zippers, Velcro®, and the like.

According to various embodiments, the various components of the frame 100 described herein may be constructed from a variety of materials of suitable strength for withstanding loads applied by the removable play yard liner and any children or other items placed therein (e.g., dynamic loads resulting from a child jumping). For example, the various frame members 102, 104, 106 may be constructed from generally rigid materials, such as aluminum or high-modulus polymer materials.

As will be appreciated from the description herein, various modifications may be made to the play yard frame embodiments described herein while remaining within the scope of the present inventions. In various embodiments, the play yard frame may include any number of vertical frame members, which may be arranged in a variety of ways. As an example, the play yard frame may include a plurality of vertical frame members positioned in a triangular, trapezoidal, or circular relationship. In addition, the play yard frame may include vertical channels defined on some or all of the vertical frame members, and may include more than one vertical channel defined on a single vertical frame member. Further, in various embodiments, the play yard frame's upper and lower horizontal frame members may be comprised of any number of individual members, including a single, unitary upper or lower horizontal frame member. In addition, the play yard frame may be configured not to collapse.

Play Yard Liner

Figure 7:
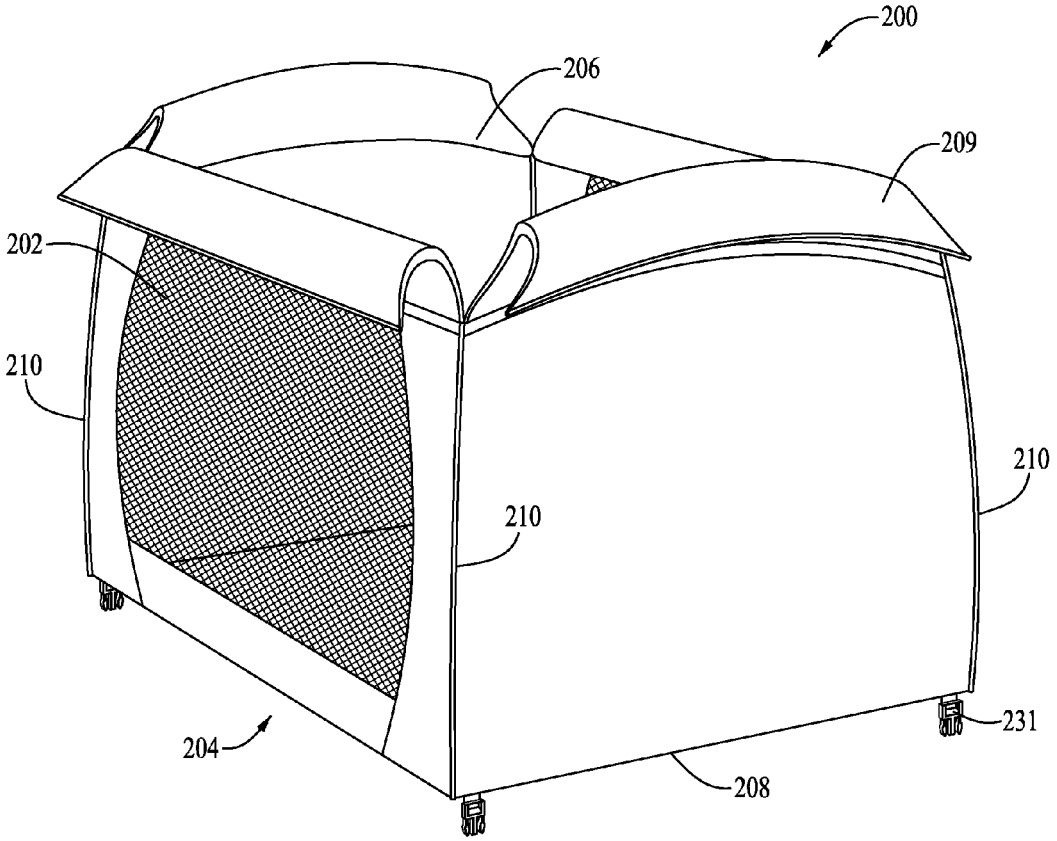
FIG. 7 shows a perspective view of a play yard liner according to one embodiment of the present invention.

FIG. 7 illustrates a removable play yard liner 200 according to one embodiment. In the illustrated embodiment, the liner 200 is a unitary fabric enclosure defined by four sidewalls 202 and a floor panel 204. Together, the sidewalls 202 and floor panel 204 define a partially enclosed area having an upper opening and a generally rectangular cross-section. The sidewalls 202 further define an upper perimeter 206 and lower perimeter 208 of the liner 200. As shown in FIG. 7, the liner 200 also includes four flap panels 209, which extend outwardly from the liner's upper perimeter 206. In various embodiments, the flap panels 209 are fabric panels having an inner edge that extends along the liner's upper perimeter 206. As described in greater detail herein, the flap panels 209 are configured to extend over and substantially cover the upper horizontal frame members 102 of the play yard frame 100 when the liner 200 is attached to the frame 100.

The liner 200 also includes four engagement members 210 attached to outer portions of the liner 200 at the liner's four corners. In the illustrated embodiment of FIG. 7, the engagement members 210 are vertically oriented and extend the full height of the side walls 202 (e.g., from their upper perimeter 206 to lower perimeter 208). According to various embodiments, the engagement members 210 are generally dimensioned to be inserted into the channels 110 of the play yard frame 100 and thereby secure the play yard liner 200 in tension between the frame's vertical frame members 106.

Figure 8:
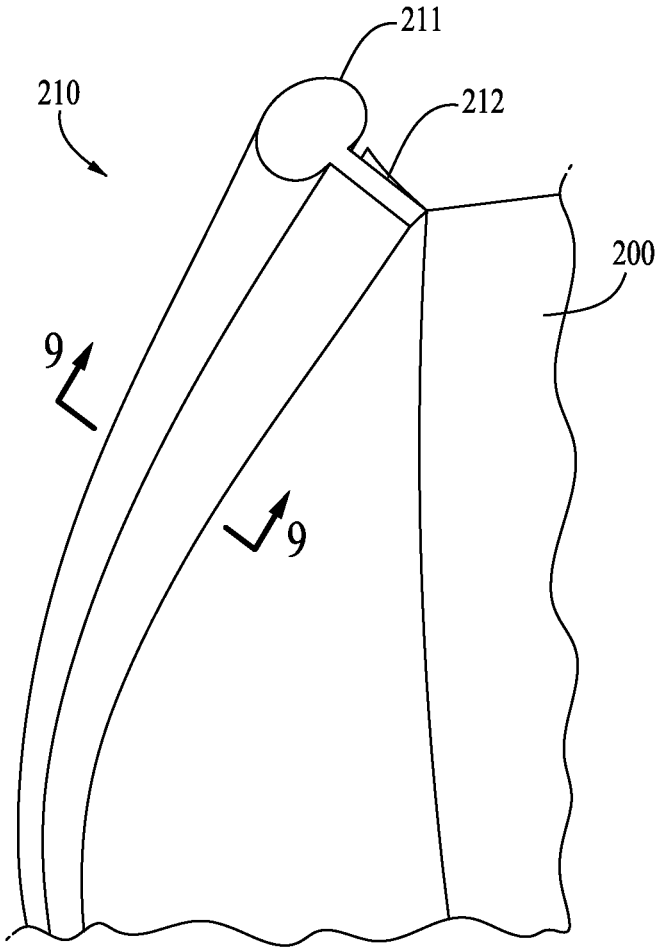
FIG. 8 shows a perspective view of an engagement member secured to a play yard liner according to one embodiment of the present invention.

For example, FIG. 8 shows an engagement member 210 according to one embodiment. In the illustrated embodiment, the engagement member 210 comprises a rod 211 having a generally elliptical cross-section dimensioned to fit within one of the channels 110. The engagement member 210 further comprises a flange 212, which extends outwardly from the rod 211 and is attached to the play yard liner 200. The rod 211 and flange 212 may be formed, for example, from single piece of material (e.g., an extruded piece of polypropylene material).

Figure 9:
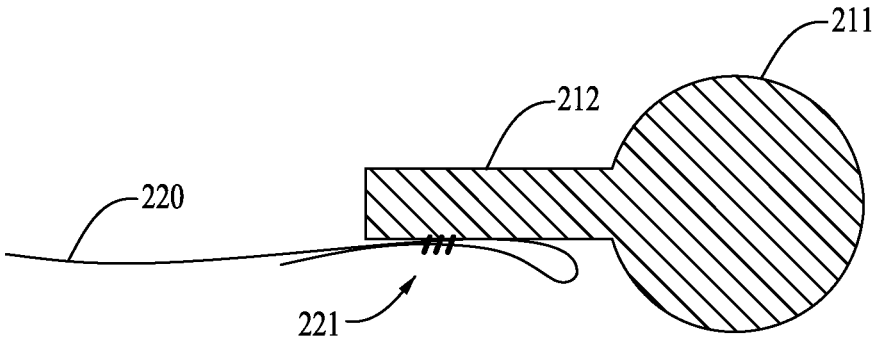
FIG. 9 shows a cross-sectional view of an engagement member secured to a tab of a play yard liner according to one embodiment of the present invention.
Figure 10:
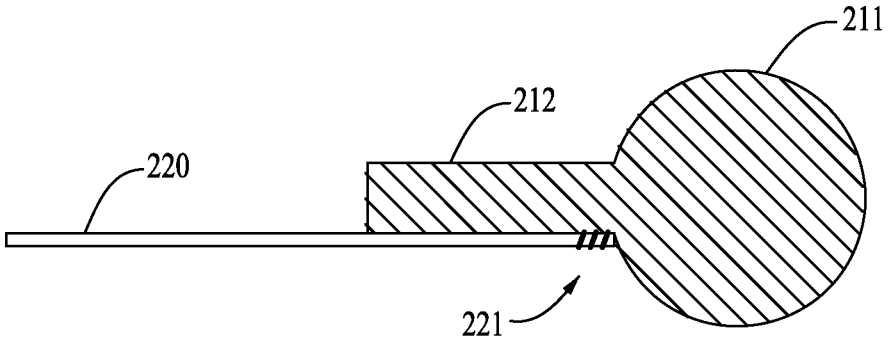
FIG. 10 shows a cross-sectional view of an engagement member secured to a tab of a play yard liner according to another embodiment of the present invention.
Figure 11:
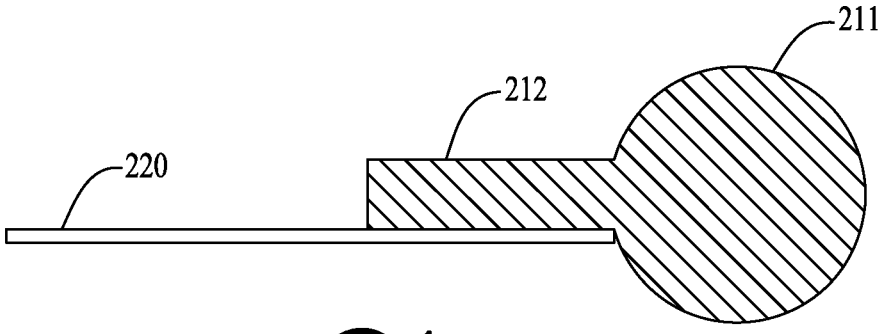
FIG. 11 shows a cross-sectional view of an engagement member secured to a tab of a play yard liner according to yet another embodiment of the present invention.

According various embodiments, the engagement member 210 is secured to the liner 200 via its flange 212, which may be affixed to the play yard liner 200 in a variety of ways. For example, in the illustrated embodiment of FIG. 9, the sidewalls 202 include a fabric tab 220 extending outwardly from the play yard liner 200 and the engagement member's flange 212 is attached by stitching 221 to the fabric tab 220. As shown in FIG. 9, the stitching 221 secures the fabric tab 220 to a medial portion of the flange 212. In another embodiment, shown in FIG. 10, the fabric tab 220 is attached to the flange 212 by stitching 221 positioned proximate to the end of the flange 212 adjacent the rod 211. In yet another embodiment, shown in FIG. 11, the fabric tab 220 is bonded to the flange 212 (e.g., by an adhesive disposed along the length of the flange 212). According to various other embodiments, the flange 212 may be secured directly to one of the sidewalls 202 of the play yard liner 200 (e.g., where the sidewalls do not include a fabric tab) and may be attached using any suitable method of securing the flange to the liner 200.

Figure 12:
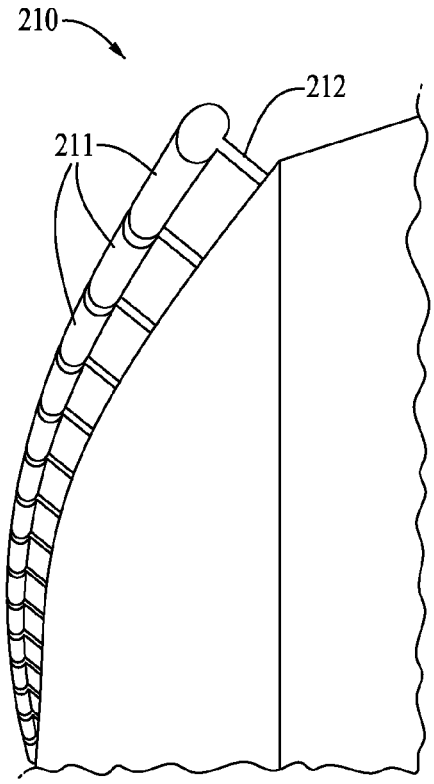
FIG. 12 shows a perspective view of an engagement member secured to a play yard liner according to another embodiment of the present invention.

FIG. 12 shows an engagement member 210 according to another embodiment. In the illustrated embodiment, the engagement member 210 comprises a rod segmented into a plurality of rod segments 211 each having their own outwardly extending flange 212. Each rod segment 211 has a generally elliptical cross-section dimensioned to fit within one of the channels 110 and is individually attached to the play yard liner 200 via its respective flange 212. Each rod segment may be attached to the play yard liner 200 via the methods described herein (e.g., those shown in FIGS. 9-11). In addition, the rod 211 and flange 212 of FIG. 12 may be formed from a single piece of material cut into the various rod segments (e.g., an extruded piece of polypropylene material cut into segments).

Figure 13:
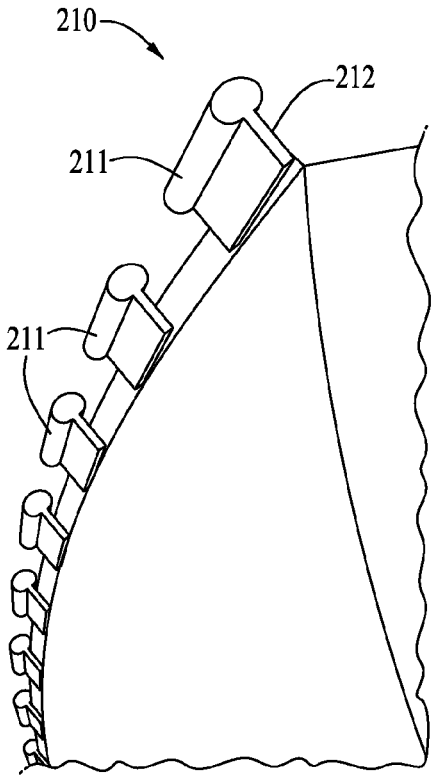
FIG. 13 shows a perspective view of an engagement member secured to a play yard liner according to yet another embodiment of the present invention.

As shown in FIG. 12, the rod segments 211 are placed closely together and are vertically aligned with one another. As such, the rod segments 211 may be inserted into a channel 110 in much the same manner as the single, continuous rod of FIG. 8. In another embodiment, shown in FIG. 13, the engagement members 210 comprise similar rod segments 211 connected to the play yard liner 200 via flanges 212. However, in the embodiment of FIG. 13, the rod segments are substantially spaced from another. As in the embodiment of FIG. 12, the rod segments 211 shown in FIG. 13 are vertically aligned and may be easily inserted into one of the channels 110.

In certain embodiments, the engagement members 210 are configured to be generally flexible and bendable. For example, in the illustrated embodiments of FIGS. 12 and 13, the spacing of the engagement member's rod segments 211 along the play yard liner 200 permits the corner of the liner 200 to remain flexible and generally does not inhibit the ability of the play yard liner's corners to be folded or otherwise contorted. As described in greater detail herein, such flexible embodiments of the engagement members 210 may be incorporated in certain machine washable embodiments of the play yard liner 200.

As noted above, the play yard frame's channels 110 may have a variety of cross-sectional dimensions. As such, the engagement members 210 may also be provided in a variety of cross-sectional dimensions, each configured to fit within a corresponding channel 110. For example, the engagement members 210 may have a rectangular or triangular cross-section. In addition, it is not necessary that the cross-sectional shape of the engagement members 210 and channels 110 are the same. For example, in one embodiment, the channel 110 may have a substantially square cross-section dimensioned to receive a substantially circular engagement member 210.

Referring back to FIG. 1, the liner 200 also includes four lower liner fasteners 231 positioned at the corners of the liner 200 proximate the lower end of the engagement members 210. For example, in one embodiment, the lower liner fasteners 231 comprise male side-release buckle components configured to be inserted within female side-release buckle components (e.g., the above-descried lower frame fasteners 131). In addition, as described in greater detail herein, the liner 200 may also include upper liner fasteners positioned proximate the upper perimeter 206 and configured to secure the liner 200 to the upper horizontal frame members 102 (e.g., the upper liner fasteners 232 of FIG. 20 described below). According to various embodiments, the fastener components provided on the liner 200 may comprise a variety of fasteners (e.g., snaps, buttons, clasps, buckles, zippers, Velcro®, and the like) and may be configured to engage corresponding fasteners on the play yard frame 100.

As will be appreciated from the description herein, the various components of the liner 200—including the sidewalls 202, floor panel 204, and engagement members 210—may be constructed from a variety of materials, including various combinations of fabric and non-fabric materials. For example, in the illustrated embodiment of FIG. 1, the sidewalls 202 are formed from a breathable mesh fabric material with solid fabric material surrounding the mesh material along edge portions of the sidewalls 202. Similarly, the floor panel 204 is formed from a solid fabric material.

In certain embodiments, the materials used to form various components of the liner 200 are constructed from machine-washable materials. In such embodiments, the fabrics used to construct the liner may be, for example, washable nylon, while the non-fabric components (e.g., the engagement members 210 and fasteners 231) may be formed from washable, durable plastics or other polymer materials. In particular, the engagement members 210 may be configured to be sufficiently flexible and bendable in order to be placed in a washing machine (e.g., engagement members comprising single, continuous rods made from a flexible and washable material, or segmented rods such those shown in the embodiments of FIGS. 12 and 13). In the above-described washable play yard liner embodiments, the liner 200 is generally configured to endure multiple machine washings without sustaining damage to its various components and is configured such that it is not necessary for a user to remove components from, or otherwise modify, the liner 200 for washing.

As will be appreciated from the description herein, various other modifications may be made to the play yard liner embodiments described herein while remaining within the scope of the present inventions. For example, in certain embodiments the play yard liner may not include a floor panel and/or a flap panel. In addition, various embodiments of the play yard liner may be configured to be secured to the various embodiments of the play yard frame described herein. As such, the liner may include any number of sidewalls arranged in a variety of ways corresponding to a particular play yard frame embodiment. Indeed, the liner may include a plurality of sidewalls defining a shape other than the rectangular shape illustrated herein. For example, the liner may comprise a single or multiple sidewalls defining other shapes such as rounded rectangles, circles, ovals, triangles, and pentagons. In yet another embodiment, the liner may be comprised of separate sidewall panels configured to be individually positioned on the play yard frame. For example, such separate sidewall panels may each include engagement members disposed on side edges of the panels, fasteners disposed on their upper and lower perimeters, and/or individual flap panels. In addition, the liner may include any number of engagement members positioned on the liner to correspond with one or more channels defined on the play yard frame.

Securing the Play Yard Liner to the Play Yard Frame

As noted earlier, various embodiments of the play yard liner 200 are configured to be secured to the play yard frame 100 in order to provide a play yard enclosure for a child. FIGS. 14-21 illustrate various steps of a method for securing the liner 200 to the frame 100 according to various embodiments.

Figure 14:
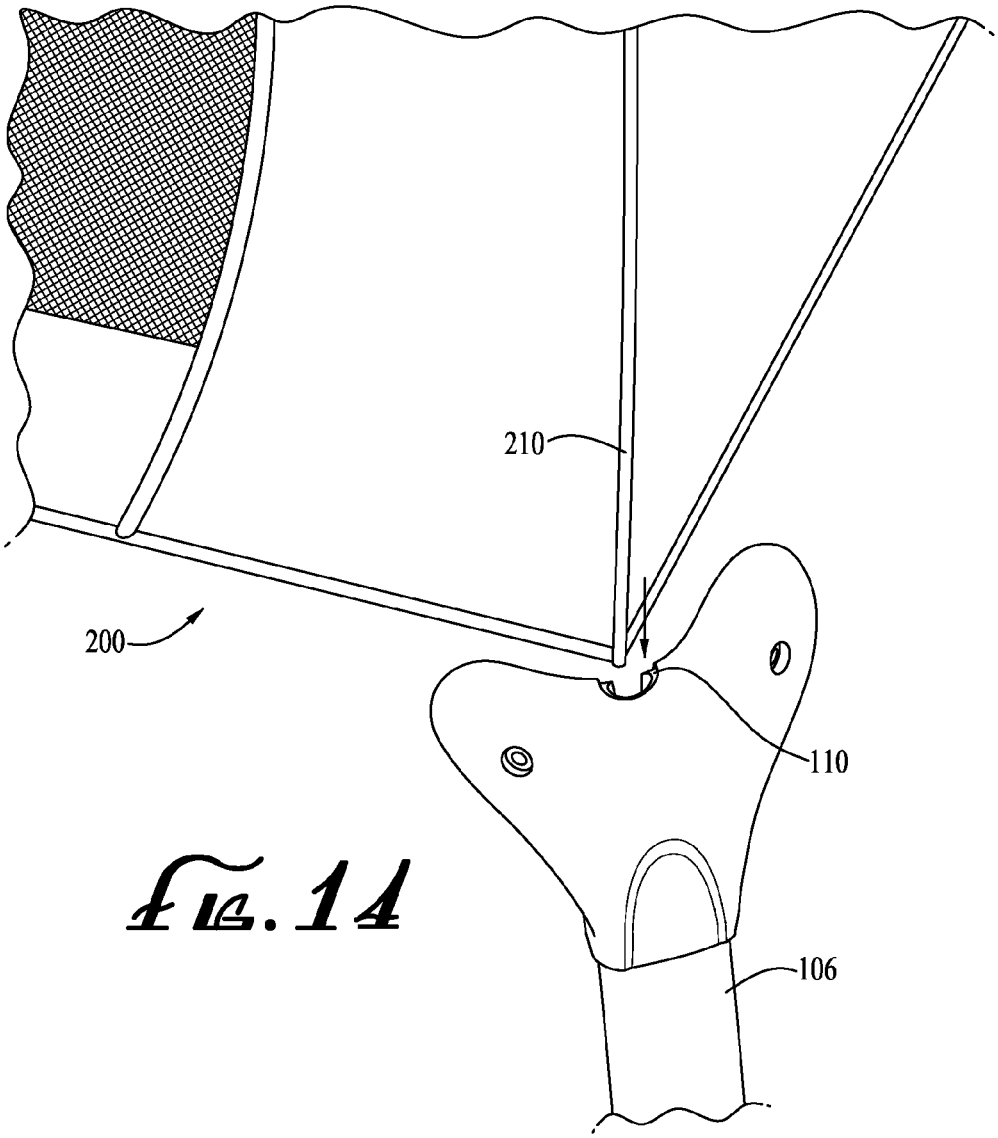
FIG. 14 shows a perspective view of a play yard liner engagement member being inserted into the channel of a vertical frame member according to one embodiment of the present invention.
Figure 15:
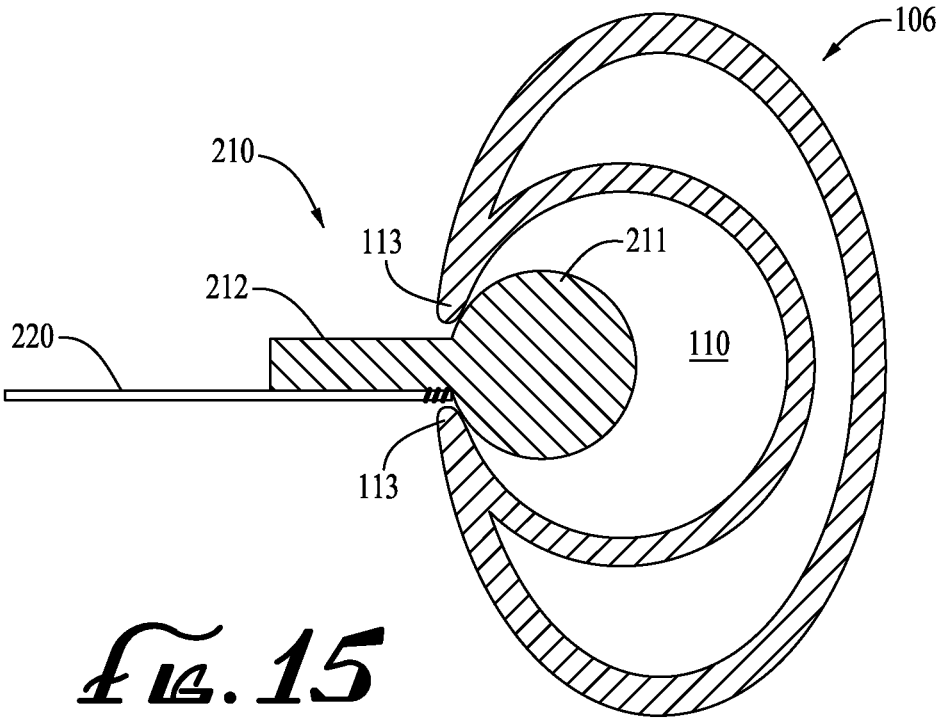
FIG. 15 shows a cross-sectional view of an engagement member positioned within a vertical frame member channel according to one embodiment of the present invention.

First, as shown in FIG. 14, each of the engagement members 210 disposed on the liner 200 are inserted into a corresponding one of the channels 110 defined along the vertical frame members 106. This may be accomplished at each corner of the liner 200 by inserting the lower end of the engagement member 210 into the upper opening 115 of the channel 110, such that the engagement member's flange 212 is aligned with the channel's gap 114 (e.g., as shown in FIG. 15 described below). The engagement member 210 is then inserted fully within the channel 110 such that a portion of the liner's sidewalls 202 is adjacent the respective vertical frame member 106 defining the channel 110. Upon inserting each of the liner's engagement members 210 into a corresponding channel 110, the sidewalls 202 and floor panel 204 of the liner 200 will be held in tension between the frame's vertical frame members 106.

FIG. 15 shows a cross-sectional view of an upper portion of the channel 110 with the engagement member 210 positioned therein according to one embodiment. As shown, the engagement member's rod 211 is positioned within the channel 110, while the engagement member's flange 212 extends through the gap between the channel arms 113. In the illustrated embodiment, the cross-sectional area and width of the upper portion of the channel 110 is substantially larger than the cross-sectional area and width of the rod 211. Among other advantages, this configuration enhances the ease with which the engagement member 210 may be positioned within the channel 110 as it is not necessary that engagement member's rod 211 be perfectly aligned with the channel 110 in order to be inserted into the channel 110 and guided downward.

In the embodiment of FIG. 15, the engagement member's flange 212 is attached to a fabric tab 220 extending outwardly from the play yard liner 200. This configuration permits the play yard's fabric portions to remain substantially out of contact with the vertical frame member 106 when the play yard liner 200 is secured to the play yard frame 100, thereby eliminating undesirable friction applied to the liner's fabric portions. In addition, in the embodiment of FIG. 15, the liner's fabric tab 220 is stitched to the flange 212 at a location proximate to the rod 211. As a result, when the rod 211 is inserted into the channel 110, the stitching securing the flange 212 to the fabric tab 220 is positioned substantially between the channel arms 113. This configuration effectively conceals the stitching from view when the rod 211 is inserted into the channel 110. As such, when the liner 200 is secured to the frame, the liner 200 appears directly adjacent the vertical frame members 106, while remaining substantially out of contact with frame 100 and minimizing the friction applied to the liner's fabric portions.

Figure 16:
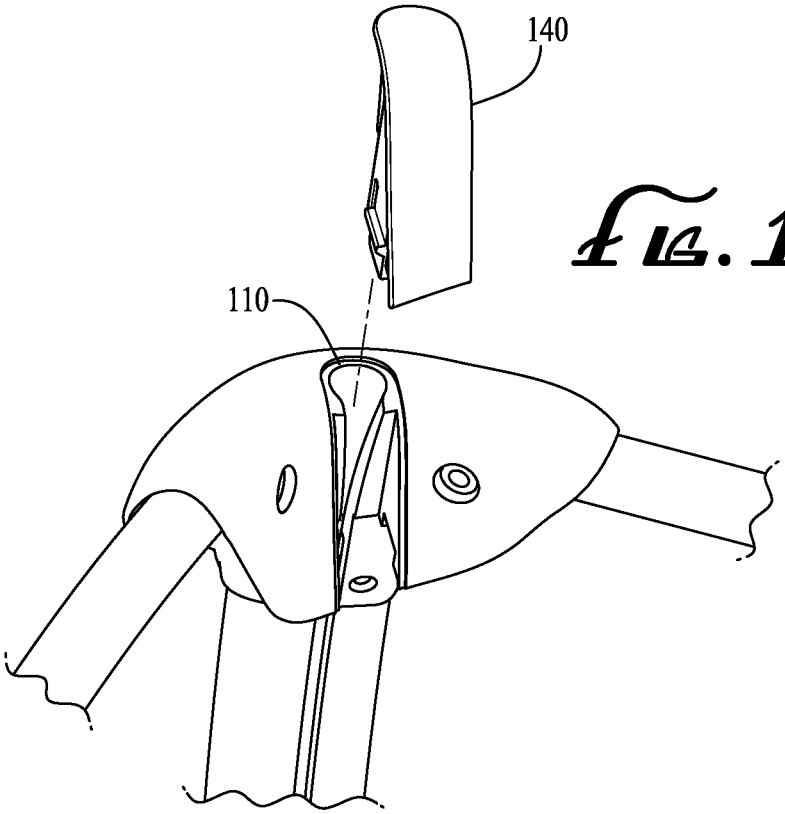
FIG. 16 shows a perspective view of an end cap disengaged from a vertical frame member channel according to one embodiment of the present invention.
Figure 17:
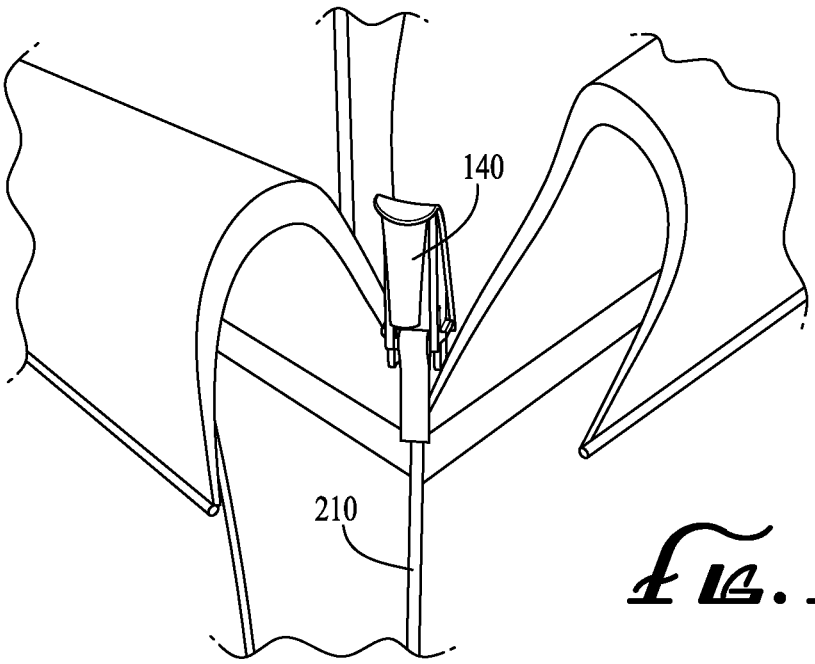
FIG. 17 shows a perspective view of an end cap positioned on a play yard liner according to one embodiment of the present invention.

After fully inserting the engagement members 210 into the channels 110, an end cap may be placed into the top of each respective channel 110 in order to secure the engagement members 210 within the channels 110. For example, FIG. 16 illustrates an end cap 140 according to one embodiment. In the illustrated embodiment, the end cap 140 is a separate component configured to be inserted into the channel 110 and selectively locked into place (e.g., using a snapping action or latch mechanism). In other embodiments, such as that shown in FIG. 17, the end cap 140 may be affixed to the top of the engagement member 210 such that the engagement member 210 may be not be fully inserted into the channel 110 without the end cap 140 locking into place.

Figure 18:
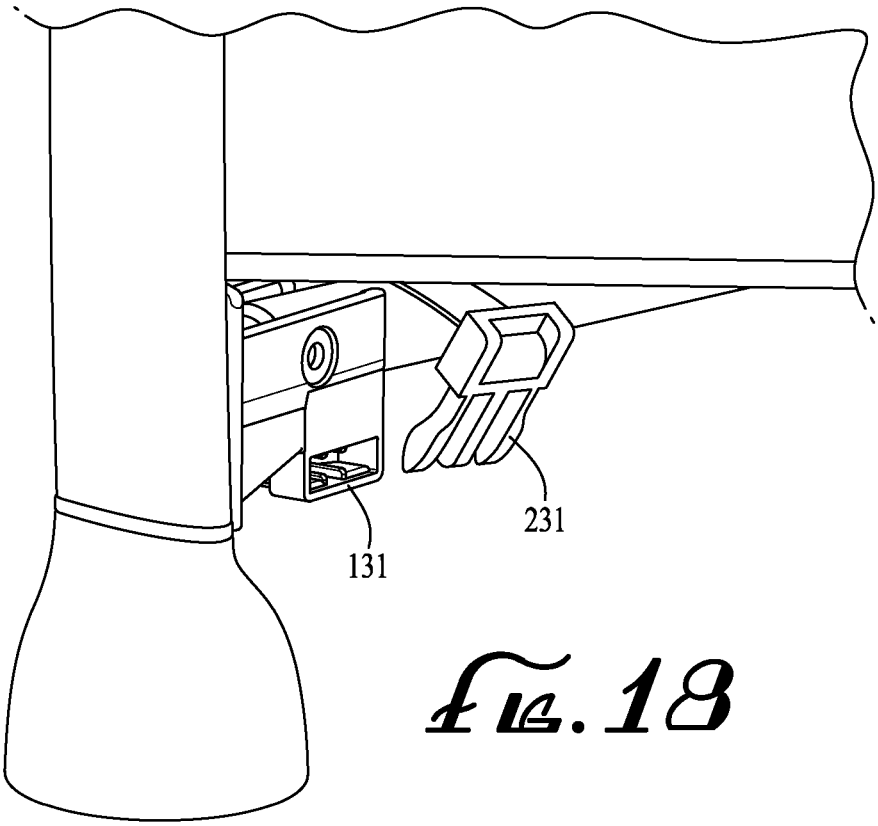
FIG. 18 shows a perspective view of a lower liner fastener being engaged with a a lower frame fastener according to one embodiment of the present invention.
Figure 19:
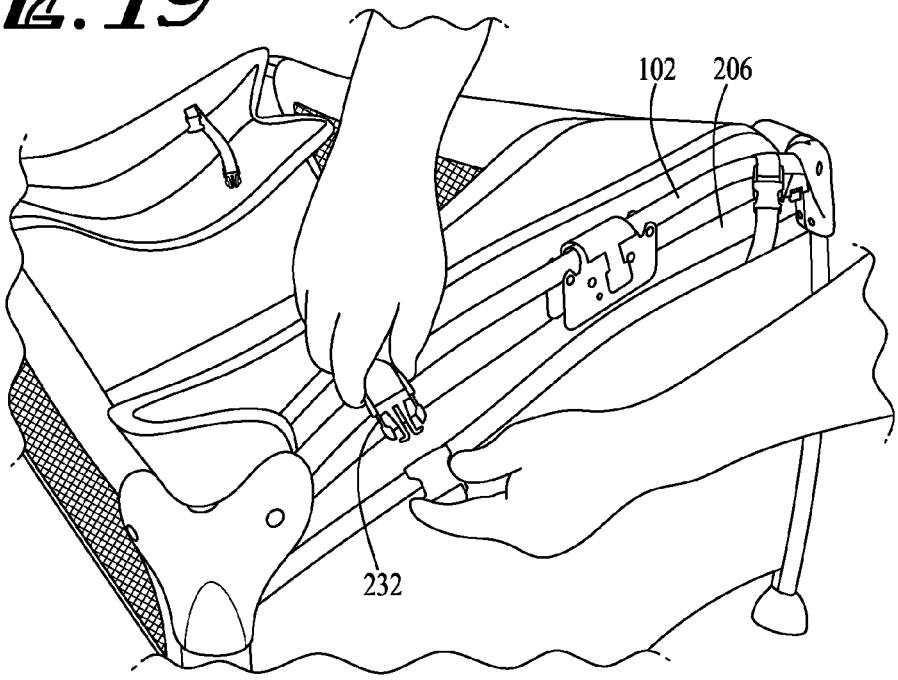
FIG. 19 shows a perspective view of an upper perimeter of a play yard liner being secured to upper horizontal frame members of a play yard frame according to one embodiment of the present invention.
Figure 20:
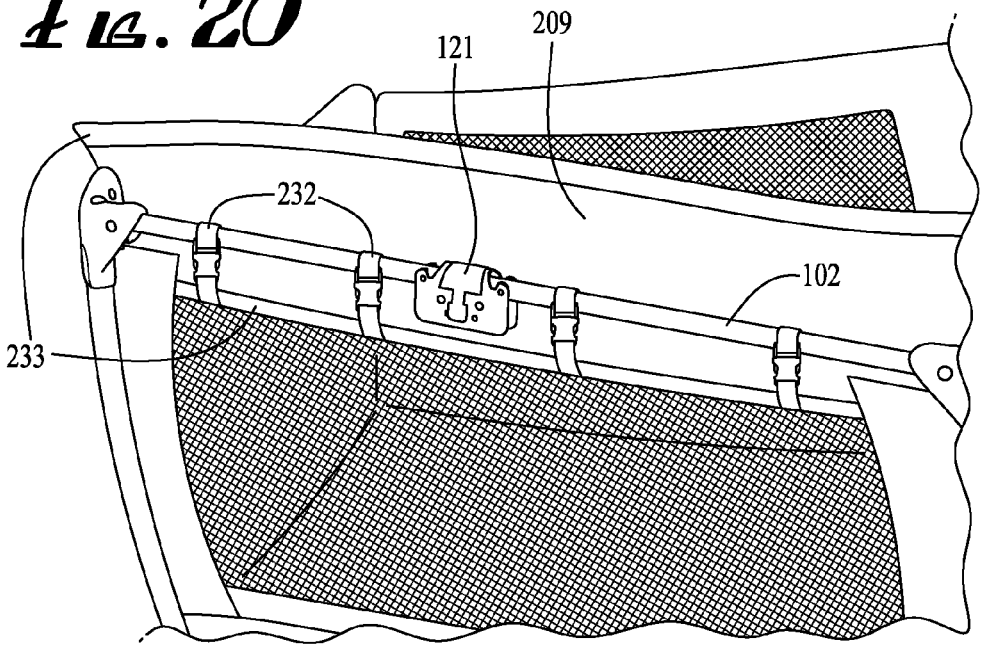
FIG. 20 shows a perspective view of a play yard liner having an upper perimeter secured to a play yard frame according one embodiment of the present invention.

Next, as shown in FIG. 18, each of the lower liner fasteners 231 are secured to the corresponding lower frame fasteners 131, further securing the liner 200 to the frame 100. Next, as shown in FIGS. 19 and 20, upper liner fasteners 232 disposed along the upper perimeter 206 of the liner 200 are secured to the upper horizontal frame members 102. According to various embodiments, the upper liner fasteners 232 are configured to wrap around the upper horizontal frame member 102 and may be secured by any suitable fastening mechanism (e.g., buckle, snap, Velcro®, etc.). For example, in the illustrated embodiment, the upper liner fasteners 232 comprises male side-release buckle component affixed to a fabric strip configured to wrap around an upper horizontal frame member 102 and a female side-release buckle component configured to receive the male component. By engaging the upper liner fasteners 232, the upper perimeter 206 of the liner 200 is secured to the upper horizontal frame members 102, thereby providing additional support to maintain the sidewalls 202 of the liner 200 in a substantially upright, vertical position around the perimeter of the play yard.

Figure 21:
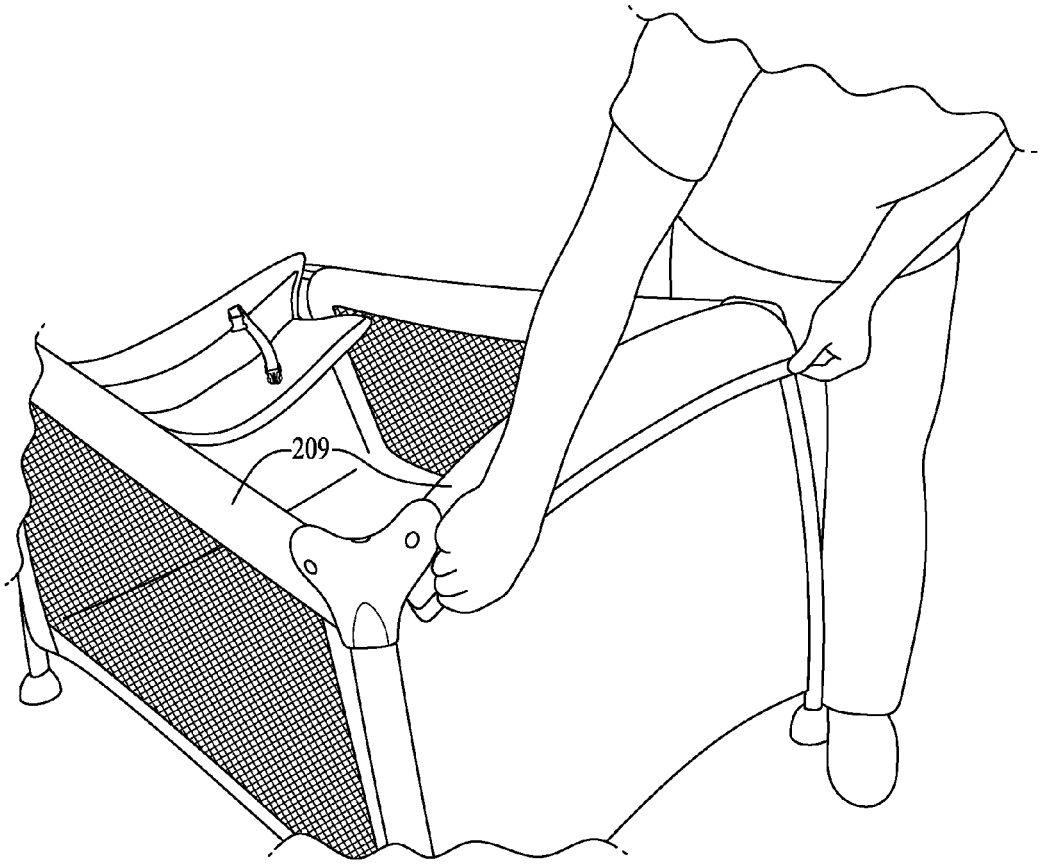
FIG. 21 shows a perspective view of a play yard liner having flap panels secured over upper horizontal frame members of a play yard frame according to one embodiment of the present invention.

Next, the flap panels 209 of the liner 200 are lifted over the upper horizontal frame members 102 and pulled downward adjacent the outer sides of the sidewalls 202. As shown in FIG. 20, the flap panels 209 include flap fasteners 233 in the form of Velcro® strips disposed along outer edges of the panels and along the upper perimeter 206 of the play yard 200. Accordingly, as shown in FIG. 21, the flap panels 209 may be secured over the upper horizontal frame members 102 by engaging the flap fasteners 233 with one another. By securing the flap panels 209 in this manner, the flap panel covers the components of the frame 100 accessible from the interior of the play yard liner 200 and provides a safety barrier between a child positioned within the play yard and the various frame components. In particular, the flap panels 209 are configured to cover the upper joint members 121. As will be appreciated from the description herein, the flap fasteners 233 may be comprised of any other suitable fasteners, including—but not limited to—snaps, buckles, and various other hook and loop combinations.

By securing the play yard liner 200 to the play yard frame 100 in the manner described herein, a complete play yard assembly may be achieved in which the play yard's sidewalls are supported in tension by vertical frame members, thereby defining a substantially vertical, rectangular perimeter within which a child may safely play or rest.

Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A children's play yard comprising:

a play yard frame comprising:

one or more lower horizontal frame members;

one or more vertical frame members attached to said lower horizontal frame members, wherein at least a portion of said vertical frame members extends upwardly from said lower horizontal frame members, and one or more upper horizontal frame members extending between upper portions of the one or more vertical frame members and defining an upper perimeter of said play yard frame; and a removable play yard liner comprising one or more sidewalls;

wherein one or more vertical frame members define one or more vertical channels having upper openings positioned at a height proximate to the one or more upper horizontal frame members, and wherein said play yard liner defines one or more engagement members configured to be inserted within said vertical channels;

wherein said sidewalls of said play yard liner extend between said vertical frame members of said play yard frame and define a bounded area within said play yard when said engagement members are engaged with said vertical channels;

wherein said vertical channels and said engagement members are configured such that said engagement members and said vertical channels can be disengaged and said removable play yard liner can be removed from said play yard frame without disassembling said play yard frame;

wherein said play yard liner is constructed from machine-washable materials and is configured for being machine-washed when removed from said play yard frame; and wherein the play yard frame further comprises an upper connecting member positioned between adjacent upper horizontal frame members of the one or more upper horizontal frame members, wherein the upper connecting member pivotally connects the adjacent upper horizontal frame members to a vertical frame member of the one or more vertical frame members, and the upper connecting member defines an upper opening that is aligned with the upper opening of the vertical channel of the vertical frame member.

2. The children's play yard of claim 1, wherein said one or more engagement members are disposed on said sidewalls of said play yard liner.

3. The children's play yard of claim 2, wherein said one or more engagement members comprise one or more rods disposed vertically along one or more of said sidewalls and dimensioned to slide within one of said vertical channels.

4. The children's play yard of claim 3, wherein said one or more rods are each segmented into a plurality of rod segments, said rod segments being vertically aligned, collectively spanning the height of a portion of side one or more sidewalls, and permitting said sidewalls to remain substantially flexible.

5. The children's play yard of claim 3, wherein:

said one or more rods each include at least one flange affixed to a portion of said one or more sidewalls;

said vertical frame members each comprise at least one channel wall defining one of said vertical channels; said channel wall defining a longitudinal gap that extends along a respective one of said vertical channels; and said one or more rods and vertical channels are dimensioned such that, when a respective one of said one or more rods is positioned within one of said vertical channels, said respective rod's flange extends outwardly from said vertical channel through said gap.

6. The children's play yard of claim 5, wherein said flange is affixed to said sidewalls such that, when each of said rods are engaged with a respective one of said vertical channels, said sidewalls do not contact said channel wall.

7. The children's play yard of claim 5, wherein said flange is affixed to said portion of said sidewalls by stitching, said stitching being positioned on said flange such that, when a respective one of said one or more rods is slid within one of said vertical channels, said stitching is positioned substantially within said channel's gap and is substantially concealed from view.

8. The children's play yard of claim 1, wherein said vertical channels and said engagement members have an at least partially elliptical cross-section.

9. The children's play yard of claim 1, wherein said engagement members are constructed from a flexible, resilient material.

10. The children's play yard of claim 1, wherein said play yard frame is collapsible.

11. The children's play yard of claim 1, wherein said play yard liner further comprises one or more lower liner fasteners and wherein said play yard frame further comprises one or more lower frame fasteners, said lower liner fasteners and said lower frame fasteners being configured to engage one another when said engagement members are fully inserted within said vertical channels.

12. The children' play yard of claim 1, further comprising one or more end caps configured for being inserted into upper ends of said vertical channels when said engagement members are engaged with said vertical channels.

13. A children's play yard comprising:

a play yard frame comprising:

one or more lower horizontal frame members; and one or more vertical frame members attached to said lower horizontal frame members, wherein at least a portion of said vertical frame members extends upwardly from said lower horizontal frame members and wherein said one or more vertical frame members define one or more vertical channels; and a removable play yard liner comprising one or more sidewalls and one or more engagement members disposed vertically on said sidewalls;

wherein said sidewalls of said play yard liner extend between said vertical frame members of said play yard frame and define a bounded area within said play yard when said engagement members are inserted within said vertical channels;

wherein said one or more vertical channels define an upper opening having a cross-sectional width that is substantially larger than said cross-sectional width of said engagement members and wherein the cross-sectional width of said vertical channels tapers downward such that the cross-sectional width of a medial portion of said vertical channels is less than said cross-sectional width of said upper opening of said vertical channels; and wherein the play yard frame further comprises:

adjacent upper horizontal frame members pivotally connected to a vertical frame member of the one or more vertical frame members; and an upper connecting member positioned between the adjacent upper horizontal frame members, wherein the upper connecting member pivotally connects the adjacent upper horizontal frame members to the vertical frame member of the one or more vertical frame members, and the upper connecting member defines an upper opening that is aligned with the upper opening of the vertical channel of the vertical frame member.

14. The children's play yard of claim 13, wherein said vertical frame members each comprise at least one channel wall defining one of said vertical channels; said channel wall defining a longitudinal gap that extends along a respective one of said vertical channels.

15. The children's play yard of claim 14, wherein the width of said longitudinal gap tapers downward such that the width of a medial portion of said longitudinal gap is less than the width of an upper portion of said longitudinal gap.

16. A children's play yard comprising:

a play yard frame comprising:

one or more lower horizontal frame members; and one or more upper horizontal frame members defining an upper perimeter of said play yard frame; and one or more vertical frame members attached to said lower horizontal frame members, wherein at least a portion of said vertical frame members extends upwardly from said lower horizontal frame members and wherein said vertical frame members are configured to support said upper horizontal frame members in a spaced apart relationship with said lower horizontal frame members; and a removable play yard liner configured for being removably secured to said play yard frame, said play yard liner comprising:

one or more sidewalls defining an upper perimeter of said play yard liner;

one or more flap panels operatively connected to said play yard liner and including one or more flap fasteners configured to selectively secure said flap panels over said upper horizontal frame members; and one or more upper liner fasteners disposed proximate said upper perimeter of said play yard liner, said upper liner fasteners being configured to secure said upper perimeter of said play yard liner to said upper horizontal frame members;

wherein said sidewalls of said play yard liner extend between said vertical frame members of said play yard frame and define a bounded area within said play yard when said play yard liner is secured to said play yard frame, and wherein said one or more flap panels are configured for substantially covering said upper horizontal frame members, and wherein said one or more flap panels substantially cover said one or more upper liner fasteners when the play yard liner is installed to the play yard frame; and wherein the one or more vertical frame members each define one or more vertical channels, and wherein the play yard frame further comprises an upper connecting member positioned between adjacent upper horizontal frame members of the one or more upper horizontal frame members, wherein the upper connecting member pivotally connects the adjacent upper horizontal frame members to a vertical frame member of the one or more vertical frame members, and the upper connecting member defines an upper opening that is aligned with the vertical channel of the vertical frame member.

17. The play yard of claim 16, wherein said play yard frame is configured for being collapsed.

18. The play yard of claim 17, wherein said one or more upper horizontal frame members comprise a plurality of upper horizontal frame members pivotably coupled to one another by upper joint members; and wherein said one or more flap panels are configured for covering said upper joint members when said play yard frame is in an erected position.

19. The children's play yard of claim 16, wherein:

said vertical frame members define one or more vertical channels;

said play yard liner further comprises one or more engagement members configured to be inserted within said vertical channels in order to secure said play yard liner to said play yard frame.

20. The children's play yard of claim 19, wherein said play yard liner further comprises one or more lower liner fasteners and wherein said play yard frame further comprises one or more lower frame fasteners, said lower liner fasteners and said lower frame fasteners being configured to engage one another when said engagement members are fully inserted within said vertical channels.

21. A method for securing a removable play yard liner to a play yard frame, said method comprising:

setting up a play yard frame to have one or more vertical frame members each defining vertical channels and one or more upper horizontal frame members;

orienting a play yard liner having one or more sidewalls, one or more flap panels, one or more upper liner fasteners, and one or more engagement members such that said engagement members are generally adjacent said vertical frame members;

sliding said one or more engagement members into said vertical channels such that the full length of said engagement members is within said vertical channels;

after sliding said one or more engagement members into said vertical channels, engaging the one or more upper liner fasteners disposed on said play yard liner to removably secure an upper perimeter of said play yard liner to said upper horizontal frame members;

subsequent to engaging the one or more upper liner fasteners, positioning said one or more flap panels over upper portions and around outer side portions of said one or more upper horizontal frame members;

securing said one or more flap panels over said one or more upper horizontal frame members, such that the one or more flap panels substantially cover the one or more upper liner fasteners; and further comprising sliding the one or more engagement members through an upper opening of an upper connecting member positioned between adjacent upper horizontal frame members of the one or more upper horizontal frame members, wherein the upper opening of the upper connecting member is aligned with the vertical channel of a vertical frame member of the one or more vertical frame members.

22. The method of claim 21, further comprising the step of engaging one or more lower liner fasteners disposed on said play yard liner with one or more lower play frame fasteners disposed on said play yard frame to removably secure a lower perimeter of said play yard liner to said play yard frame.

23. The method of claim 21, further comprising inserting end caps into upper ends of said vertical channels.

* * * * *